United States Patent [19]

Eriksson

[11] 4,318,365

[45] Mar. 9, 1982

[54] DEVICE FOR LIFTING ANIMALS

[76] Inventor: Kjell-Ivan Eriksson, Lada 4629, GåxsjöS-830 70 Hammerdal, Sweden

[21] Appl. No.: 828,168

[22] Filed: Aug. 26, 1977

[51] Int. Cl.[3] ..... A61D 3/00

[52] U.S. Cl. ..... 119/100; 269/238

[58] Field of Search ..... 119/100, 102; 269/238

[56] References Cited

U.S. PATENT DOCUMENTS

| | | | |
|---|---|---|---|
| 442,733 | 12/1890 | Shampel | 269/238 |
| 2,901,012 | 8/1959 | Crispin | 269/238 |
| 2,909,153 | 10/1959 | Mckinley et al. | 119/100 |

FOREIGN PATENT DOCUMENTS

| | | | |
|---|---|---|---|
| 582077 | 11/1946 | United Kingdom | 269/238 |
| 819829 | 9/1959 | United Kingdom | 119/100 |

*Primary Examiner*—Jay N. Eskovitz

*Attorney, Agent, or Firm*—Charles E. Brown

[57] ABSTRACT

This invention relates to a device for lifting weighty animals, comprising a rigid yoke and two movable spaced-apart gripping members which are disposed on arms each of which is connected to the yoke and an adjustment mechanism by means of first and second hinges being spaced apart from each other, the arms being pivotable by means of the adjustment mechanism so as to grip the hip bone projections of the animal.

5 Claims, 4 Drawing Figures

DEVICE FOR LIFTING ANIMALS

This invention relates to a device for lifting cattle, horses or other weighty animals, comprising a rigid yoke to which two spaced-apart gripping members are connected, said gripping members being movable towards and away from each other by means of a suitably screwable adjustment mechanism to enable gripping of the animal, preferably on the hip bone projections thereof, and means for connecting the device to arbitrary lifting means, such as a hook. Lifting devices of this type are previously known i.e. by the U.S. Pat. Nos. 2,909,153, 2,942,575, 3,085,553 and 3,827,406.

A frequent phenomenon among large animals such as cattle and horses is that they remain lying in conjunction with calving, foaling etc. Also diseased conditions of different kinds may render the animals incapable of rising. In order to make it possible for a veterenary to make a diagnosis, it is then necessary to get the animal into a standing position. Besides the animal may catch bedsores if it is not helped up.

It has proved that a cow will rise on the fore legs by a reflex if the posterior portion thereof is lifted by means of a lifting device of the type referred to above. This is of course the manner in which a cow normally rises. An alternative possibility has also been to lift the animal under the belly thereof, but then another reflex leads to effect that the animal readily lies down again.

Though the lifting devices previously known by the above mentioned patent specifications per se have made possible a lifting of the animal in the manner indicated, the same have been associated with the disadvantage that the two gripping members of the device on one hand have come to fit against the hip bone projections with highly unequal pressures at the beginning of the lifting of the animal from a lying position and on the other they have been refractory during the lifting procedure from the lying to the standing position. This has often brought about that the animal remains disinclined for assisting in rising itself.

The present invention aims at eliminating the above mentioned disadvantages and for this purpose it concerns an animal lifting device which is characterized in that the gripping members are disposed on arms which are hingedly connected on one hand to the yoke by means of first hinges and on the other to the adjustment mechanism by means of second hinges being spaced apart from the first hinges and the adjustment mechanism is arranged to move the two second hinges towards and away from each other so as to provide said movements of the gripping members towards and away from each other by pivoting the arms in relation to the first hinges.

By the hinge-connection between the yoke, the adjustment mechanism and the gripping members realized in accordance with the invention, the device becomes flexibly adapted to the movements of the cow or the animal during the lifting procedure, a fact which has proved to stimulate the animal to assist in rising itself.

With reference to the enclosed drawings, a closer description of an embodiment of the device of the invention will follow hereinafter. In the drawings.

Figure 1:
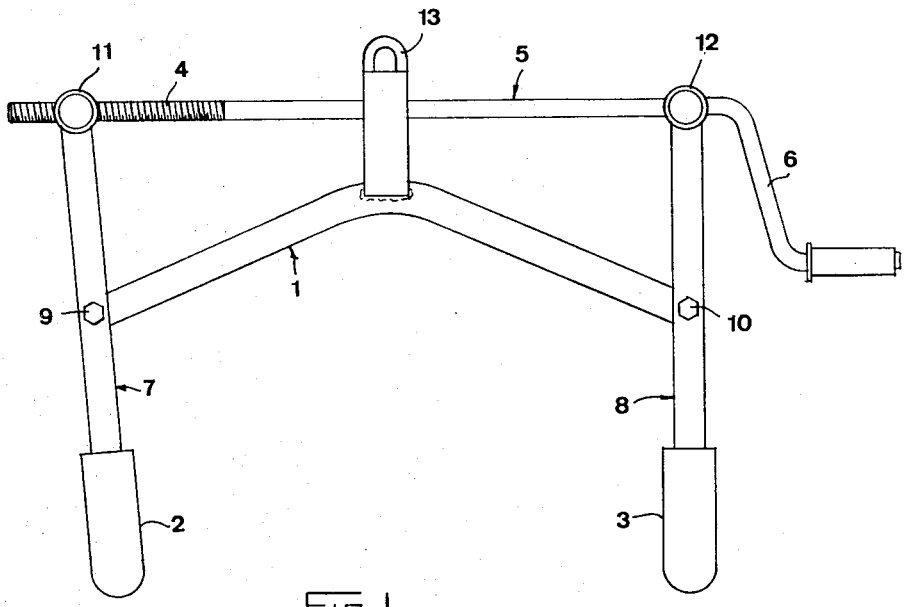
FIG. 1 is a front view of the device according to the invention.
Figure 2:
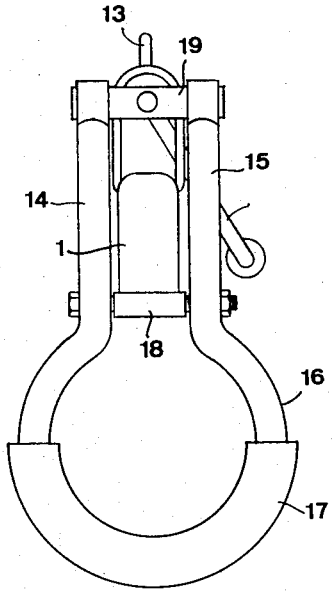
FIG. 2 is a side view of the same device.

The device illustrated in FIGS. 1 and 2 comprises a rigid yoke 1, two gripping members 2, 3 and an adjustment mechanism, which in this case is realized as a rod 5 provided with threads 4, said rod having a crank 6 by means of which it is manually rotatable.

The gripping members 2, 3 are disposed on arms 7 and 8 respectively which are hingedly or pivotably connected on one hand to the yoke 1 by first hinges 9, 10 and on the other to the adjustment mechanism or the rod 5 by second hinges 11, 12 which are spaced apart from the first hinges, as viewed in the longitudinal direction of the arms. The threaded portion 4 of the rod 5 is engaged in a correspondingly threaded portion of the hinge 11, while the hinge 12 is axially immovably connected to the rod, when rotating the rod 5 in one direction or the other, the two hinges 11, 12 will either be moved towards or away from each other and hence the gripping members will be moved away from and towards each other respectively due to the fact that the arms 7, 8 are pivoted in relation to the first hinges 9, 10.

Connection means in the form of a ring 13 for connecting the device to arbitrary lifting means, such as a hook of a tackle, a chain or the like, is in this case attached to the yoke 1 approximately half-way between the ends thereof. From FIG. 1 it appears that the yoke is curved or bent so as to closely correspond to the shape of the animal.

As clearly appears from FIG. 2, each arm 7, 8 presents two substantially parallel elements 14, 15 interconnected by means of a circular element 16 forming a gripping member. This circular gripping member or element may advantageously be covered with a soft material, such as a rubber hose 17, in order to protect the animal from injuries. Between the two parallel elements 14, 15, a sleeve 18 is provided rotatably mounted on a bolt, said sleeve being connected to the yoke 1 and forming said first hinge of each arm. A shaft 19 is rotatably mounted at the top between the two elements 14, 15, said shaft being connected to the rod 5 and forming said second hinge. Concerning the hinge 11 in particular, the shaft 19 has a threaded through hole in which the threaded portion 4 of the rod 5 is engaged. The corresponding shaft of the hinge 12 has a simple through hole in which the rod is freely rotatable, the hinge being axially immovable in relation to the rod in any suitable manner, e.g. by means of collars (not shown).

In the embodiment shown, the yoke 1 is located in such a way in relation to the rod 5 that the first hinges 9, 10 are between the gripping members 2, 3 and the second hinges 11, 12.

Figure 3:
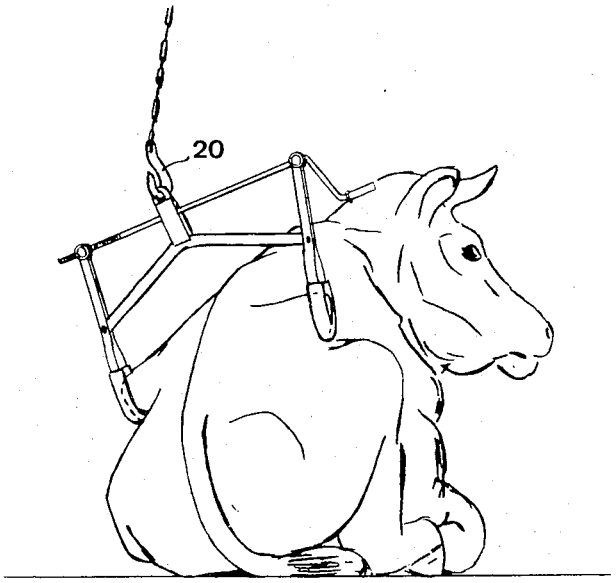
FIG. 3 is a perspective view illustrating the device clamped to a cow in a half-recumbent position.
Figure 4:
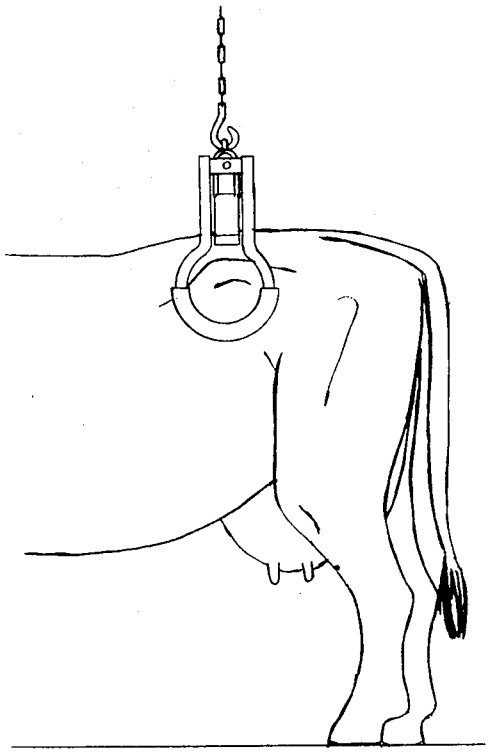
FIG. 4 is a partial view illustrating the same device and animal with the animal shown in standing position.

When an animal is to be lifted, the gripping members 2, 3 are—by means of the crank 6—moved away from each other the distance necessary for passing the device over the hip bone projections of the animal. Then the gripping members are—by actuating the crank in the opposite direction of rotation—moved so far towards each other that a firm grip of the animal is provided, whereupon the lifting hook 20 is connected to the ring 13 as illustrated in FIG. 3. Now the animal can readily be rised from the lying position illustrated in FIG. 3 to the standing position illustrated in FIG. 4.

By the hinged four-point connection between the yoke, rod and arms associated with the gripping members, the device according to the invention is given an adaptability in rising the animal making it possible to rise the animal substantially vertically from a lying to a standing position. In doing so the pressure from the device is distributed approximately equally onto the two hip bone projections. Another advantage of the device according to the invention is that it requires a comparatively limited space above the animal due to the curved shape of the yoke. This is important in confined rooms, wherein also the lifting apparatus, to which the device is attached, has to be housed.

What I claim is:

1. A device for lifting animals, said device comprising a rigid yoke and two spaced apart gripping members depending from said yoke for engaging an animal hip bone projections, said yoke including an upwardly arched central portion, attaching means carried by said yoke central portion and projecting upwardly therefrom for attaching said yoke to a lifting mechanism, an arm carrying each of said gripping member in depending relation to said yoke, first hinges connecting intermediate portions of said arms to opposite ends of said yoke and mounting said gripping members for swinging movement relative to said yoke and towards and away from each other, an adjustment mechanism extending between said arms remote from said gripping members and on the side of said yoke away from said gripping members to facilitate location of said yoke immediately adjacent a back of an animal to be lifted, said adjustment mechanism extending through said attaching means and second hinges connecting said arms to said adjustment emchanism for adjusting the spacing of said gripping members.

2. A device according to claim 1 wherein each gripping member is in the form of a generally circular member for engaging an animal hip bone projections, and each arm is in the form of two substantially parallel elements connected to and extending from ends of said generally circular member, each first hinge includes a sleeve and pin arrangement carried by an adjacent end of said yoke and extending between said substantially parallel elements, and each second hinge includes a pin and sleeve arrangement carried by an adjacent part of said adjustment mechanism and between said substantially parallel elements remote from said generally circular member.

3. Device according to claim 2 wherein in each first hinge said sleeve is carried by said yoke and said pin extends through said sleeve and between said substantially parallel elements.

4. Device according to claim 3 wherein in each second hinge said pin is carried by said adjustment mechanism and extends through sleeves carried by free ends of said substantially parallel elements.

5. Device according to claim 2 wherein in each second hinge said pin is carried by said adjustment mechanism and extends through sleeves carried by free ends of said substantially parallel elements.

* * * * *